US009913566B1

(12) United States Patent
McCormick

(10) Patent No.: US 9,913,566 B1
(45) Date of Patent: Mar. 13, 2018

(54) LOBBY PAN

(71) Applicant: Joseph McCormick, Homer Glen, IL (US)

(72) Inventor: Joseph McCormick, Homer Glen, IL (US)

( * ) Notice: Subject to any disclaimer, the term of this patent is extended or adjusted under 35 U.S.C. 154(b) by 0 days.

(21) Appl. No.: 15/365,310

(22) Filed: Nov. 30, 2016

(51) Int. Cl.
*A47L 13/52* (2006.01)
*B08B 9/093* (2006.01)

(52) U.S. Cl.
CPC ..... *A47L 13/52* (2013.01); *B08B 9/093* (2013.01)

(58) Field of Classification Search
CPC ..... A47L 13/52
See application file for complete search history.

(56) References Cited

U.S. PATENT DOCUMENTS 1,748,336 A * 2/1930 Finnell ..... A47L 13/52 15/257.1
3,002,209 A * 10/1961 McKinstry ..... A47L 13/11 15/1
2004/0134004 A1* 7/2004 Kaleta ..... A47L 13/52 15/104.002

* cited by examiner

*Primary Examiner* — Randall Chin
(74) *Attorney, Agent, or Firm* — The Law Offices of Konrad Sherinian, LLC

(57) ABSTRACT

A lobby pan comprises a receptacle having a substantially flat bottom wall of a generally rectangular shape, a rear wall extending transversely from the bottom wall and having a first height, a front wall extending transversely from the bottom wall in substantially the same direction as the rear wall and having a second height that is less than the first height, and a pair of side walls that extend in the same direction as the rear wall and are connected to the rear wall and the front wall so as to form a continuous edge that defines an aperture into the receptacle. The front wall and rear wall are separated by a suitable distance, as are the side walls. In addition, a wash port is disposed on the exterior of the lobby pan so as to enable the interior of the receptacle to be easily washed.

5 Claims, 2 Drawing Sheets

LOBBY PAN

FIELD OF THE DISCLOSURE

The present disclosure generally relates to waste receptacles. More particularly, the present disclosure relates to a lobby pan (or dust pan) having a wash port disposed on the lobby pan to allow for easy cleaning of the lobby pan.

BACKGROUND

Lobby pans, which are also known as dust pans, are well known in the prior art. In particular, lobby pans are used as a temporary receptacle for small amounts of waste, such as dust, candy wrappers, discarded food, etc., as well as refuse, such as vomit, animal feces, etc. Lobby pans are used in individual dwellings, but their use is especially widespread in commercial settings, such as office buildings, hospitals, food industry sites such as kitchens and restaurants, schools, etc.

Generally, a lobby pan will comprise a receptacle that is pivotally mounted to a shaft using any of the well-known pivotal mounting means in the art. The shaft can be connected to a handle including, for example, an aperture by which the lobby pan can be hung. When downward pressure is applied to the handle, the receptacle portion will pivot downward to allow waste and refuse to be swept into it. When upward pressure is applied to the handle, the receptacle portion will swing upwards, thereby preventing waste and refuse from falling out. In the upward position, the receptacle portion can be locked in place using a mechanism known in the art, such as a slot and hook. Alternatively, in the upward position, the lobby pan can be unlocked.

OBJECTS OF THE DISCLOSED LOBBY PAN

One object of the disclosure is to provide an improved lobby pan.

Another object of the disclosure is to provide a lobby pan for which the receptacle portion can be more easily cleaned out.

Another object of the disclosure is to provide a lobby pan with a wash port.

Another object of the disclosure is to provide a lobby pan with a wash port having a high-pressure nozzle.

Another object of the disclosure is to provide a lobby pan with a wash port that allows for cleaning the receptacle portion of the lobby pan without exposing contaminants to the user.

Other advantages of this disclosure will be clear to a person of ordinary skill in the art. It should be understood, however, that a system or method could practice the disclosure while not achieving all of the enumerated advantages, and that the protected disclosure is defined by the claims.

SUMMARY OF THE DISCLOSURE

An improved lobby pan is disclosed and claimed. In its simplest form, the lobby pan comprises a receptacle having a substantially flat bottom wall with a generally rectangular shape, a rear wall extending transversely from the bottom wall and having a first height, a front wall extending transversely from the bottom wall generally in the same direction as the rear wall and having a second height that is less than the first height, and a pair of side walls that extend in the same direction as the rear wall and are connected to the rear wall and the front wall so as to form a continuous edge that defines an aperture into the receptacle. The front wall and rear wall are separated by a suitable distance, as are the side walls. In addition, a wash port is disposed on the exterior of the lobby pan.

In a second embodiment, the disclosed lobby pan further comprises a slot formed in the upper edge of the front wall, a flexible yoke pivotally mounted to the side walls and extending between the side walls, a straight elongated shaft with a bottom end and a top end, with the bottom end being secured to the yoke at a point midway between the side walls. The yoke is responsive to pressure from the shaft, and moves between a deformed and non-deformed position. A latch coupled to the yoke is adapted to couple with the slot so that the receptacle portion can be held in place in an upright or inactive position.

In an additional embodiment, the wash port of the lobby pan is mounted on the front wall of the receptacle near the bottom wall of the receptacle. The wash port can comprise a connection port on the exterior of the receptacle that is adapted to communicate with a hose fitting. In addition, the wash port can further comprise a nozzle disposed toward the interior of the receptacle so as to direct water from the wash port into the interior of the receptacle thereby washing out debris from the interior of the receptacle. The nozzle can be adapted to transform an input water stream into a higher-pressure output water stream.

BRIEF DESCRIPTION OF THE DRAWINGS

Although the characteristic features of this disclosure will be particularly pointed out in the claims, the invention itself, and the manner in which it may be made and used, may be better understood by referring to the following description taken in connection with the accompanying drawings forming a part hereof, wherein like reference numerals refer to like parts throughout the several views and in which:

DETAILED DESCRIPTION

Figure 1:
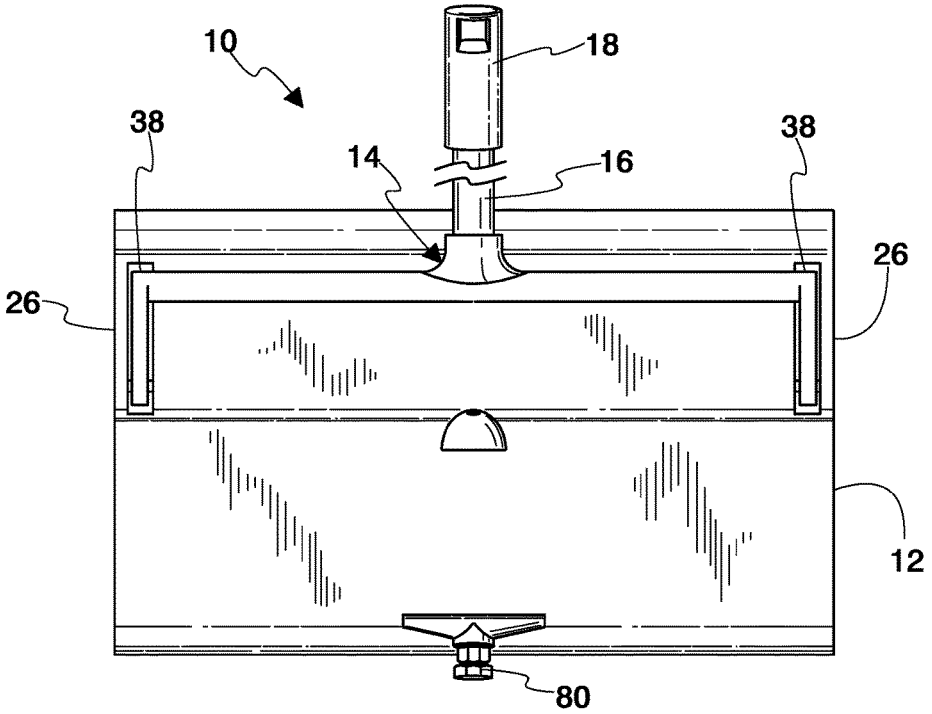
FIG. 1 is an elevational view showing a lobby pan constructed in accordance with the present disclosure.
Figure 2:
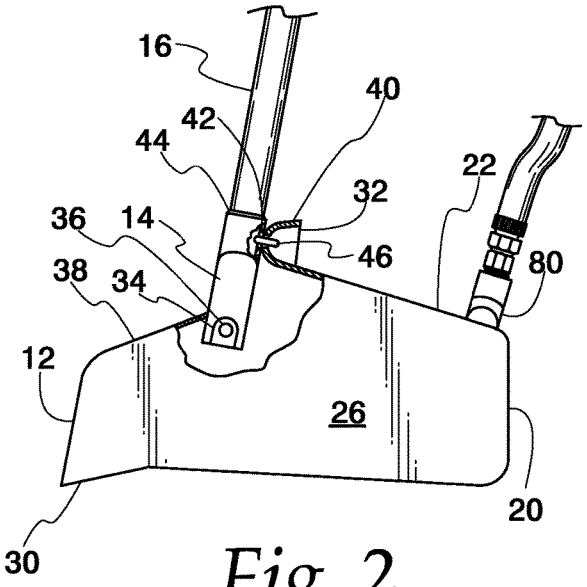
FIG. 2 is a right-side view of the disclosed lobby pan, partially cut away for clarity, and, in particular, showing the disposition of the disclosed wash port.
Figure 3:
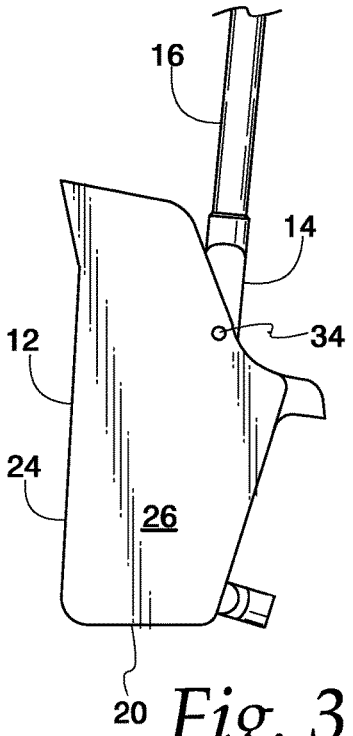
FIG. 3 is an elevational view showing the disclosed lobby pan with the receptacle in the debris carrying position.

Turning to the figures, and to FIGS. 1-3 in particular, an improved lobby pan is illustrated and generally designated by the number 10. The disclosed lobby pan includes a receptacle portion 12 that is pivotally connected to a yoke 14. The yoke is connected to one end of a shaft 16. The other end of the shaft 16 is connected to a handle 18. The receptacle portion 12 of the lobby pan 10 includes a bottom wall 20, front wall 22, a rear wall 24, and a pair of parallel separated side walls 26. The open ends of side walls 26 generally have a diagonal edge portion 38 forming a lip 30 at one end thereof, and an extension 32 at the other end.

The receptacle portion 12 of the lobby pan is shown in a deployed position in FIGS. 1 and 2. As depicted, the receptacle 12 is mounted to shaft 16 by a rotary or pivotal hinged mechanism that includes a pair of axially aligned connectors 34 provided in the side walls 26 of the receptacle 12. A pair of mounting pins 36 are mounted in in the side walls 26 and are coupled to the yoke 14. A wash port 80 is also visible in FIG. 1.

The lobby pan 10 is provided with a rim portion 40 on which is formed a slot 42 as is visible in FIG. 2. The slot 42 is formed proximate the midpoint of the rim 40. A shaft receiving or mounting socket 44 is provided at the upper extremity of the yoke 14. A tab or latch 46 having a laterally extending hook portion is formed integrally with the shaft mounting socket 44. It should be noted that the locking mechanism disclosed herein is not a limitation of the disclosure; the disclosed lobby pan will achieve the desired advantages without any kind of locking mechanism, or even any kind of mechanism to transform the lobby pan between an active position and an inactive position.

As is clearly seen in FIG. 2, when the receptacle 12 is placed on a flat surface to be cleaned, it will assume a horizontal position. The handle 18 and associated shaft 16 are locked in an upright position. In order to assume the position illustrated in FIG. 2, downward pressure must be applied to the handle 18 to transform the lobby pan 10 from the carrying position (as shown in FIG. 3 hereafter) to the active position shown in FIGS. 1 and 2. The pressure is transmitted through the shaft 16, which deforms the yoke 14 causing the tab 46 to enter and travel through the slot 42. When the operator releases the downward pressure on the handle 18, the tab 46 and hook move upward, and the handle 18 and shaft 16 will be retained in the upright position, which allows for easy transport by a user as seen in FIG. 3.

As is also best seen in FIG. 2, the disclosed lobby pan 10 includes a wash port 80, which is advantageously disposed on the front wall 22 toward the bottom wall 20 of the receptacle portion 12 of the lobby pan 10. In one embodiment, the wash port 80 is angled so that water that is directed into the wash port will spray downwards toward the rear wall 24, and be deflected throughout the entirety of the receptacle portion 12 of the lobby pan 10. However, it should be noted that the specific placement of the wash port 80 is not a limitation of this disclosure, and other placements could be used to obtain most advantages of the disclosure. For example, the wash port 80 could be placed toward the center of the bottom wall 20 of the receptacle portion 12 of the lobby pan 10, or on the diagonal edge portion 38 of the receptacle portion 12 of the lobby pan 10. The construction of the wash port 80 is discussed hereafter.

As discussed previously, when the user finishes cleaning an area, a slight downward pressure on the handle 18 will cause a slight deformation of the yoke 14 and cause release of the tab 46. An additional motion about the axis of the connectors 34 will remove the tab 46 from the slot 42. Lifting the handle 18 will permit the receptacle 12 to assume a vertical or inactive position as illustrated in FIG. 3.

When the receptacle portion 12 is in the active (horizontal) position, the user may sweep debris into the interior thereof. Certain debris is likely to become entwined or stuck onto the surface of the receptacle portion 12. In the past, the user would need to periodically clean out the interior of the receptacle portion using, for example, a bucket and rags. However, with the addition of the wash port 80, this procedure can be greatly simplified. In particular, by merely connecting the wash port 80 to a water source, and directing a stream of water into the surface of the lobby pan, the majority of debris within the receptacle portion is easily removable. In addition, dangerous contaminants can be removed without exposing the user to the same.

Figure 4:
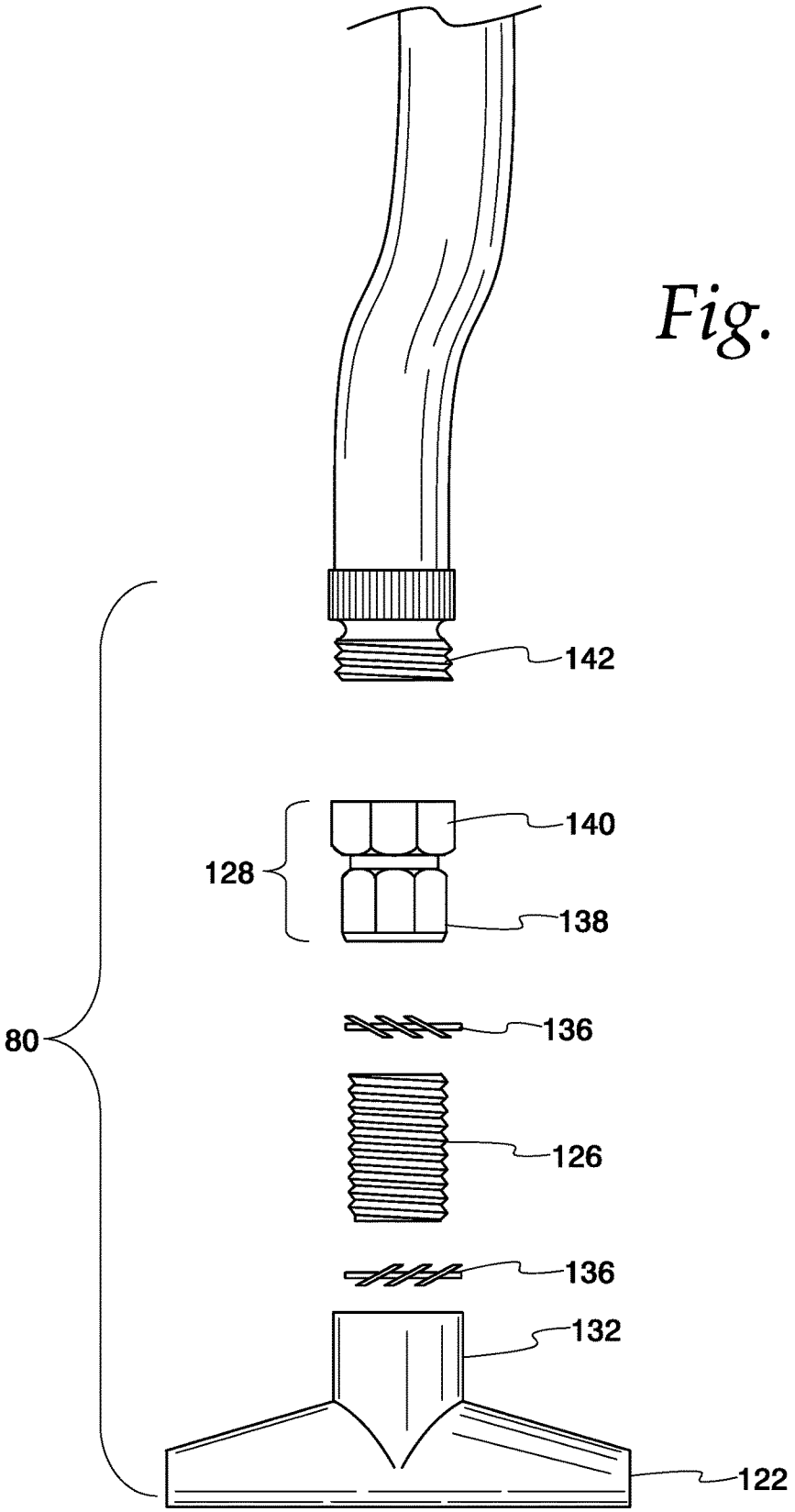
FIG. 4 is an exploded, side elevational view of a wash port constructed in accordance with the disclosure without showing the associated lobby pan.

Turning to FIG. 4, a specific construction of the wash port 80 is depicted. In particular, a tee fitting 128 comprises the upper portion of the wash port, to which a water source can be coupled. The tee fitting 128 is adapted to sit on the exterior of the receptacle portion 12 of the lobby pan 10. The tee fitting 128 includes a female threaded connection port 140 wherein the female threads are adapted to cooperate with the threads on a hose fitting 142. The tee fitting also comprises a shoulder 138 which includes internal female threads. The internal female threads of the shoulder 138 are adapted to communicate with a pipe 126, which has external male threads. A lock washer 136 locks the shoulder 138 to the top portion of the pipe 126. The pipe 126 is adapted to pass through an aperture in the receptacle portion 12 of the lobby pan 10. The bottom of the pipe 126 is coupled to a nozzle 122, and is locked in place with a lock washer 136. The nozzle 122 can be of any type, but, advantageously, can be adapted to increase the pressure of the stream that is directed within the lobby pan. In such an embodiment, a high-pressure stream will be directed downwards toward the rear wall 24 of the receptacle portion 12 of the lobby pan 10. The water will be deflected and splash to wash the entirety of the interior of the receptacle portion 12 of the lobby pan 10, thereby greatly reducing or eliminating any manual cleaning that would be required.

It should be noted that this particular construction is merely an example, and many alternative constructions of water ports could be used to implement the disclosed lobby pan. For example, a water port with an external shutoff valve could be used.

Particular embodiments of the disclosed improved lobby pan have been described, and, in certain circumstances, specific embodiments have been set forth. Such description is intended to aid persons of skill in the art in practicing the disclosed improved lobby pan without undue experimentation, rather than setting forth limitations on the scope of the claimed invention.

The foregoing description of the disclosure has been presented for purposes of illustration and description, and is not intended to be exhaustive or to limit the disclosure to the precise form disclosed. The description was selected to best explain the principles of the present teachings and practical application of these principles to enable others skilled in the art to best utilize the disclosure in various embodiments and various modifications as are suited to the particular use contemplated. It is intended that the scope of the disclosure not be limited by the specification, but be defined by the claims set forth below. In addition, although narrow claims may be presented below, it should be recognized that the scope of this invention is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional inventions are not dedicated to the public and the right to file one or more applications to claim such additional inventions is reserved.

What is claimed is:

1. A lobby pan comprising:

a) a receptacle having:

i. a substantially flat bottom wall of a generally rectangular shape, ii. a rear wall extending in a transverse manner from said bottom wall and having a first height, iii. a front wall extending in a transverse manner from said bottom wall, the front wall extending in substantially the same direction as said rear wall, the front wall having a second height that is less than the first height;

iv. said front wall and said rear wall being separated by a first distance;

v. a pair of side walls extending in a transverse manner from said bottom wall, the side walls extending in the same direction as the rear wall, and each of the side walls being connected to the front wall and rear wall so as to form a continuous edge to define an aperture into said receptacle; and b) a wash port mounted on the exterior of the lobby pan, the wash port adapted to couple with a hose fitting.

2. The lobby pan of claim 1 further comprising:

a) a slot formed in the upper edge of the front wall;

b) a flexible yoke pivotally mounted to the pair of side walls and extending therebetween;

c) a substantially straight elongated shaft having a bottom end and a top end, the bottom end being secured to said flexible yoke at a position approximately midway between the side walls;

d) said yoke being movable between a deformed and non-deformed position by application or release of pressure to the elongated shaft; and e) a latch for holding said yoke in said deformed position, said latch being formed on the yoke at a position adapted to engage said slot.

3. The lobby pan of claim 1 wherein said wash port further comprises a nozzle, said nozzle adapted to transform an input water stream to a higher-pressure output stream.

4. The lobby pan of claim 1 wherein said wash port is mounted on the front wall of the receptacle near the bottom wall of the receptacle.

5. The lobby pan of claim 4 wherein said wash port includes a connection port on the exterior of the front wall of the receptacle, said connection port adapted to couple with a hose fitting and a nozzle, and wherein said nozzle is disposed so as to face the rear wall so that water that flows through the nozzle will wash the interior of said receptacle.

* * * * *